United States Patent [19]

Haas et al.

[11] Patent Number: 4,658,687

[45] Date of Patent: Apr. 21, 1987

[54] SAW FENCE

[75] Inventors: Charles J. Haas, Centerville; Dale Timman, Sidney; John H. Stolzenberg, New Carlisle, all of Ohio

[73] Assignee: Shopsmith, Inc., Dayton, Ohio

[21] Appl. No.: 785,429

[22] Filed: Oct. 8, 1985

[51] Int. Cl.[4] ..... B27B 27/02

[52] U.S. Cl. ..... 83/438; 83/477.1; 269/238

[58] Field of Search ..... 83/438, 477.1; 269/238

[56] References Cited

U.S. PATENT DOCUMENTS

| | | | |
|---|---|---|---|
| 2,265,335 | 12/1941 | Aumann | 83/438 |
| 2,325,082 | 7/1943 | Tautz | 83/438 |
| 2,562,246 | 7/1951 | Van Dam et al. | 83/438 |
| 2,613,243 | 10/1952 | Frear | 269/238 X |
| 2,630,845 | 3/1953 | Eschenburg | 83/438 |
| 2,740,437 | 4/1956 | Oldum et al. | 83/438 |
| 2,806,493 | 9/1957 | Gaskell | 83/438 |
| 4,206,910 | 6/1980 | Biesemeyer | 83/438 X |

OTHER PUBLICATIONS

Shopsmith Mark V, Accessory Catalog-1983.

*Primary Examiner*—Donald R. Schran

*Attorney, Agent, or Firm*—Biebel, French & Nauman

[57] ABSTRACT

A saw fence having an elongate fence member, a lock-back attached to an end of the fence member for engaging a side rail of a saw table, a base member attached to an opposite end of the fence member and adapted to engage a side rail of a saw table. The base member includes a housing having a transverse channel to receive a side rail of a saw table, a hook member pivotally attached to the base member having a tongue portion which extends downwardly and inwardly from the base member, and a bolt threaded into the base member for pivotally displacing the hook member inwardly to engage a side rail in a locked position, or outwardly to disengage a side rail in a release position.

10 Claims, 7 Drawing Figures

SAW FENCE

BACKGROUND OF THE INVENTION

The present invention relates to work guides for powered woodworking machines and, more particularly, to fences which are adjustably mountable on the tables of table saws.

A typical table saw includes a base which supports a subtantially flat tabletop having a transverse slot and a pair of side rails extending along opposite sides of the tabletop. A motor is mounted beneath the tabletop and a cutting tool, which may be a circular saw blade, is mounted on the output spindle of the motor and is positioned to project upwardly through the slot. The saw blade or other cutting tool rotates in a plane which is perpendicular to the central axes of the side rails.

In order to guide a workpiece in a feed direction which is at all times parallel to the plane of rotation of the cutting tool, work guides have been developed. A common work guide is a saw fence which comprises an elongate fence body which is adjustably mountable on the side rails and includes at least one flat guide surface which extends upwardly from the tabletop and is oriented parallel to the plane of rotation of the cutting tool. A lock-back is attached to one end of the fence body and adopted to engage a first one of the side rails. A base member is attached to the opposite end of the fence body and includes mechanisms for positively securing the lockback and base member to the side rails.

An example of such a saw fence is shown in Odlum et al. U.S. Pat. No. 2,740,437. That saw fence includes a lock-back consisting of a hook bolt which extends downwardly from the fence body and is tightened against the adjacent side rail (which, in this example is a downwardly-extending flange on the tabletop). The base member includes a transverse channel which receives a tubular side rail which extends outwardly from the tabletop, and is locked to the associated rail by a lever which, when pivoted downwardly, engages the rail with a bearing surface formed on its upper end.

A disadvantage with this type of saw fence is that it is somewhat awkward to attach the base member to or remove the base member from the tubular side rail. To attach the base member, it first must be positioned beyond the end of the rail, then displaced sidewardly so that the rail telescopes into the channel. Another disadvantage with this type device is that the base member may not always accurately square the base with the side rail so that the guide surface of the saw fence is parallel to the rotational plane of the cutting tool.

Another type of saw fence is shown in Gaskell U.S. Pat. No. 2,806,493. That patent discloses a saw fence having a base member which includes a transverse channel for receiving an adjacent side rail of the saw table. The base member includes a spring-loaded tensioner button which rides against the underside of the side rail and acts to hold the bracket downwardly against the fence. However, this type of saw fence lacks structure which positively locks the fence bracket against this associated side rail, and is secured to the tabletop by opposing clamping surfaces which engage the opposing edges of the tabletop. Furthermore, like the Odlum et al. device, this saw fence lacks structure for accurately squaring the saw fence relative to the cutting tool.

Accordingly, there is a need for a saw fence having a base member which permits the fence to be attached to or removed from the side rails of the saw table by a simple vertical displacement, rather than requiring the saw fence to be slid sidewardly off the ends of the side rails. There is also a need for a saw fence having a base member which is designed to perform a squaring action in addition to locking the saw fence against the side rails.

SUMMARY OF THE INVENTION

The present invention is a saw fence which is adapted to be used in combination with a saw table of the type having a pair of side rails extending outwardly from the edges of the tabletop. The saw fence consists of a fence body having a lock-back mechanism at one end adapted to engage a first one of the side rails, and a base member at an opposite end adapted to engage a second one of the side rails. The base member includes a transverse channel which is substantially concave in shape and has an inwardly and downwardly opening mouth which is shaped to permit the base member to be displaced in a substantially vertical direction downwardly to bring the channel into engagement with a tubular side rail, or upwardly to disengage the channel from the side rail. The base member includes a housing and a hook member which is pivotally attached to the housing and includes a tongue portion which extends downwardly and inwardly to at least partially enclose the transverse channel.

The hook member is pivoted by a bolt which is attached to the hook member at one end and is threaded into the housing at the other end. The hook member is shaped such that it may be pivoted to a locked position in which the end of the tongue portion contacts the inside surface of the associated side rail, or pivoted outwardly to a release position in which the base member is free to be displaced upwardly away from the associated rail of the tabletop.

The hook member performs a dual function. When pivoted to the locked position, the hook member combines with the channel to enclose the side rail and positively secure the base member against movement relative to the rail in any direction. When pivoted to the unlocked position, the base member may be lifted from the rail. Secondly, by applying force to the inside surface of the side rail, the hook member causes the base member and channel to be drawn inwardly toward the table so that the side rail makes proper contact with the channel along its length. Since the channel is formed to be perpendicular to the guide surface of the fence body, this engagement between the side rail and channel causes the guide surface of the fence body to be aligned parallel to the rotational plane of the cutting tool.

In a preferred embodiment, the hook member includes a plate having a slot which is formed with a hemispherical bearing surface, and the threaded bolt includes a correspondingly-shaped hemispherical bearing surface which rides in the slot. The bolt extends through the slot and is captured therein on one side by the hemispherical bearing surface and on the other side by a retaining ring. The advantage of this structure is that it provides a positive engagement without requiring expensive springs or hinges.

Also in the preferred embodiment, the channel includes a plurality of raised ribs defining contact surfaces which are spaced along its length and together define a relatively precisely located channel to receive the side rail of the tabletop. The advantage of this structure is that it provides a low-cost and yet closely-toleranced channel so that the guide surface of the fence body may be properly squared when the hook member is latched.

Accordingly, it is an object of the present invention to provide a low-cost saw fence which is self-squaring; a saw fence in which the base member may be displaced substantially vertically to engage or disengage a side rail; and to provide a saw fence in which both ends of the fence member may be positively locked against the side rails of a tabletop.

Other objects and advantages of the invention will be apparent from the following description, the accompanying drawings, and the appended claims.

DETAILED DESCRIPTION OF THE PREFERRED EMBODIMENT

Figure 1:
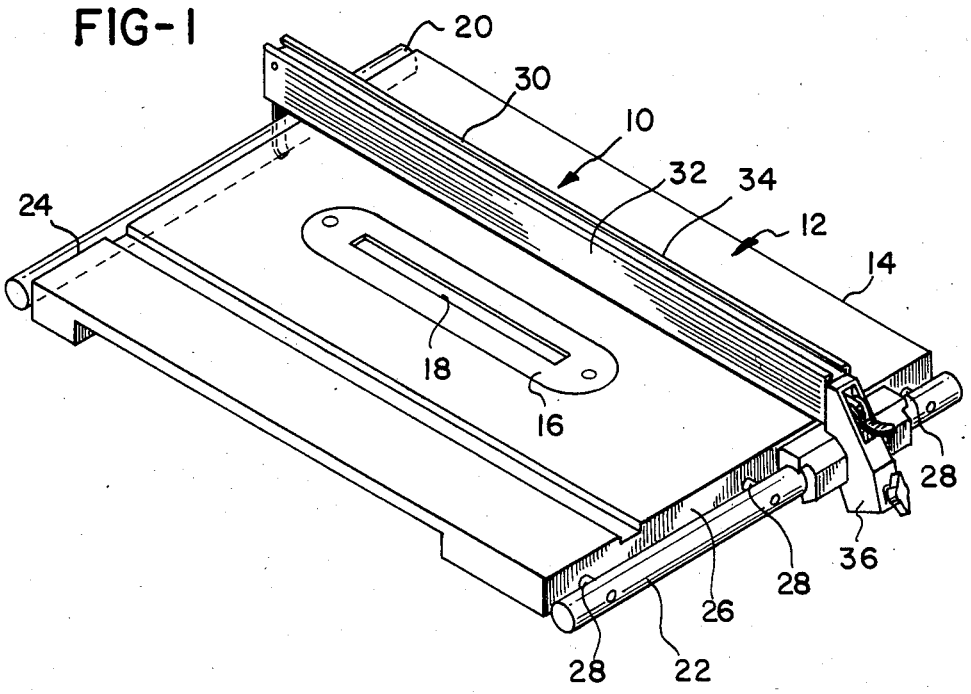
FIG. 1 is a perspective view showing a preferred embodiment of the saw fence of the present invention mounted on the tabletop of a table saw.
Figure 2:
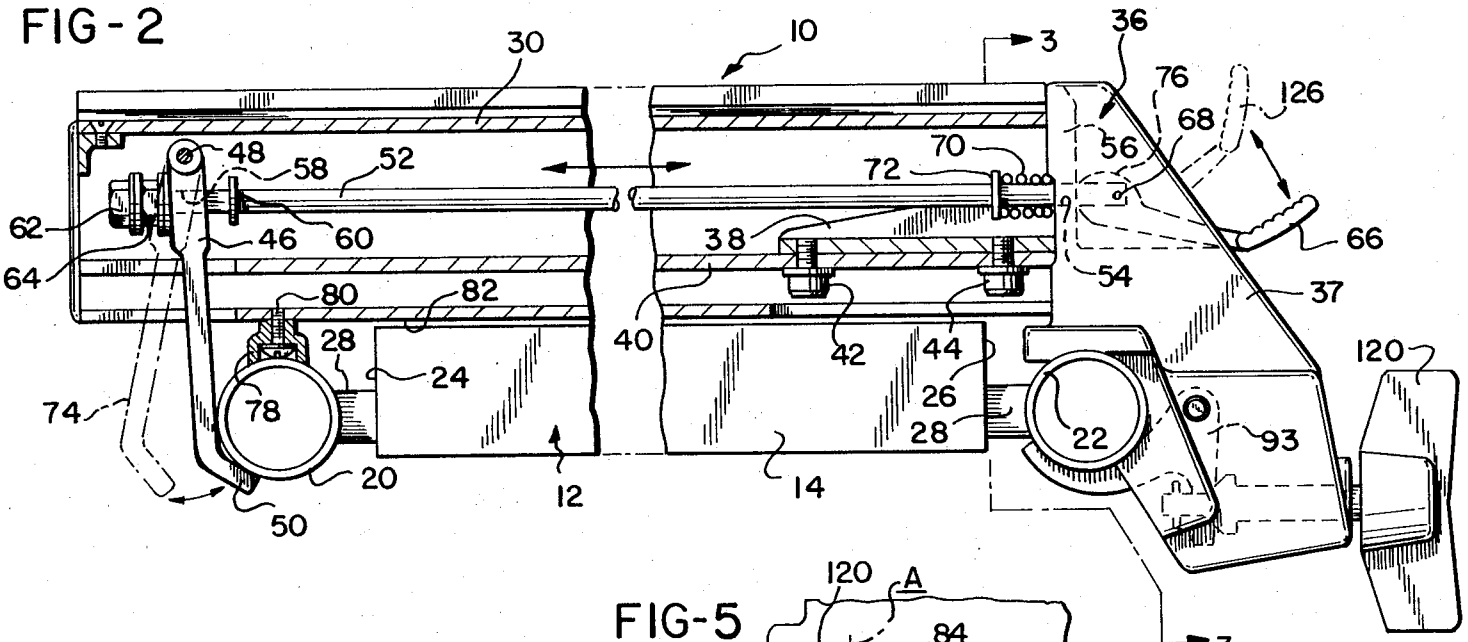
FIG. 2 is a side elevation of the saw fence and tabletop of FIG. 1 in which the fence body is shown in section, and the fence body and tabletop are broken away.

As shown in FIGS. 1 and 2, the saw fence of the present invention, generally designated 10, is adapted to be used in combination with the tabletop 12 of a table saw of the type shown, for example, in Bartlett et al. U.S. Pat. No. 4,510,980, the disclosure of which is incorporated herein by reference. The tabletop 12 consists of a substantially flat plate 14 having an insert 16 which includes an elongate slot 18 through which a rotary tool such as a circular saw blade (not shown) protrudes. The tabletop 12 also includes a pair of tubular side rails 20, 22 which are attached to the longitudinal edges 24, 26 of the plate 14 by ferrules 28.

The saw fence 10 includes an elongate fence body 30 which provides a pair of flat, opposing guide surfaces 32, 34. The fence body 30 is sized to extend beyond the longitudinal edges 24, 26 of the tabletop 12.

The fence body 30 is attached to a base member, generally deisgnated 36. The base member 36 includes a housing 37 having a bracket 38 which is shaped to telescope into the fence body and is attached to an interior flange 40 by screws 42, 44. The mounting holes in the bracket 38 and flange 40 which receive the screws 42, 44 are sized to allow for lateral adjustment relative to the base member 36.

A lock-back lever 46 is pivotally attached at one end to the fence body 30 by a pin 48, and includes a lower end having a tip 50 which is bent inwardly. A draw rod 52 extends through the lock-back lever 46, along the length of the fence body 30 and protrudes through an opening 54 in the upper wall 56 of the housing 37 (see FIG. 7).

The draw rod 52 extends through an opening 58 in the upper portion of the lock-back lever 46 and the lock-back lever is captured between a pressed retaining ring 60 and a pair of nuts 62, 64 threaded onto the end of the draw rod. The opposite end of the draw rod 52 is pivotally attached to a cam lever 66 by a pin 68. An extension spring 70 is seated on a pressed ring 72 at one end and against the interior surface of the upper wall 56 on the other. The extension spring 70 acts to urge the draw rod to the left, as shown in FIGS. 2 and 7, so that the nuts 62, 64 are urged outwardly away from the edge 24 of the table 12, allowing the lock-back lever 46 to pivot outwardly to the position 74, shown in phantom in FIG. 2.

The cam lever 66 includes a bearing surface 76 which is urged against a hardened washer 77 set in wall 56. A downward pivotal movement of the cam lever 66 causes the cam surface 76 to bear against the washer 77 and thereby draw the rod 52 to the right, as shown in Fig. 2. This action causes the nuts 62, 64 to bear against the lock-back lever 46 and urge it inwardly to engage the outer portion of the side rail 20.

In order to space the fence body 30 above the surface of the table, and thereby reduce sliding friction encountered when the fence is displaced sidewardly along the rails 20, 22 relative to the table, the end of the fence 10 immediately above the side rail 20 includes a boss 78 which is attached to the underside of the fence body by a screw 80. The lower end of the boss is shaped to matingly engage the upper wall of the side rail 20 and is sized such that the underside 82 of the fence body is spaced slightly above the top surface of the plate 14.

Figure 3:
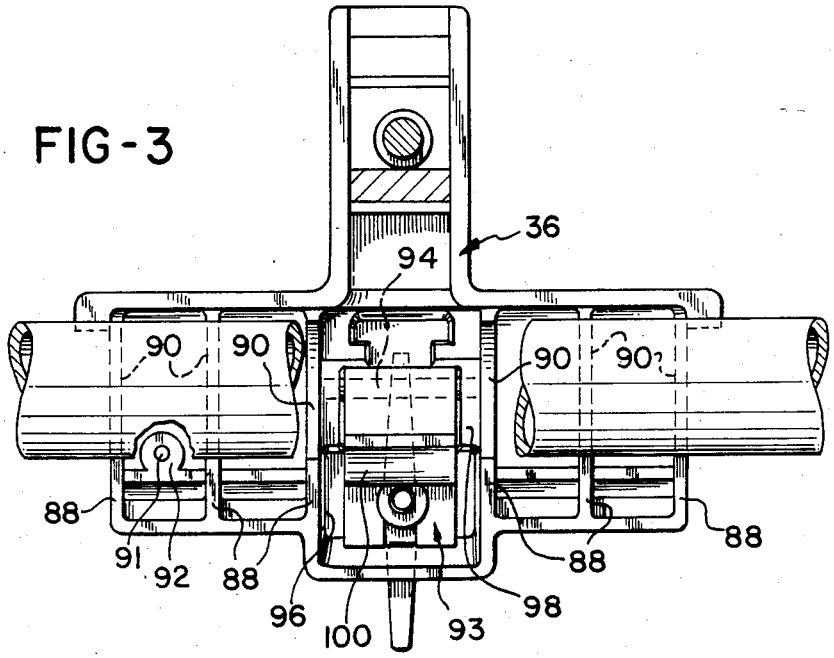
FIG. 3 is a rear elevational view of the base member of the saw fence of FIG. 2, taken at line 3—3 of FIG. 2.
Figure 7:
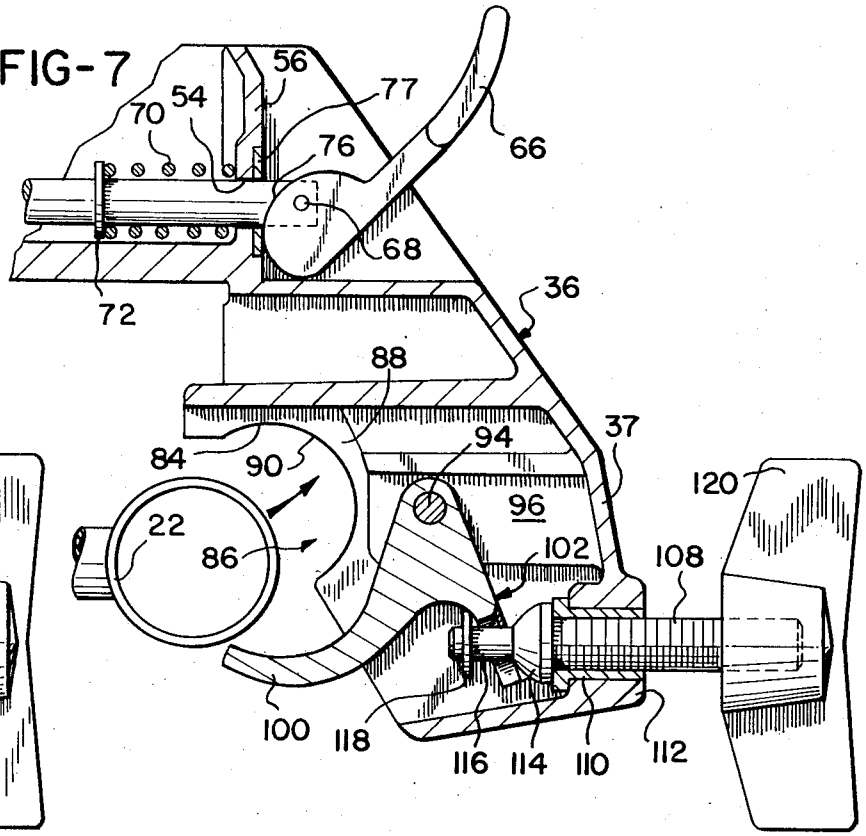
FIG. 7 is a detail of the saw fence of FIG. 1, showing a side elevation in section of the base member and hook member, adjusted to a release position.

As shown in FIGS. 3 and 7, the lower portion of the housing 37 includes a transverse channel, generally designated 84. The channel 84 includes a mouth 86 which opens inwardly and downwardly relative to the housing 37. The channel 84 includes a plurality of ribs 88 having arcuate contact surfaces 90 and extending inwardly from the channel. The contact surfaces 90 are shaped to correspond to the exterior contour of the rail 22 and are therefore circular in shape. The ribs 88 are spaced along the channel 84.

The contact surfaces 90 are precisely aligned so that the fence body 30 can be maintained perpendicular to the rail 22. However, in making some cuts, it is necessary to show the fence 10 relative to the rail 22 and blade. Accordingly, a set screw 91 is provided which is threaded into a boss 92 in the housing 39. Displacement of screw 91 inwardly skews the housing 37 from the rail 22 to align the fence body, as required.

Figure 4:
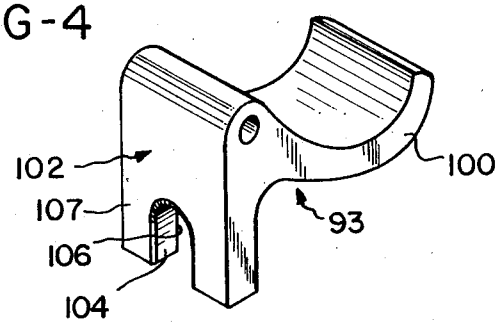
FIG. 4 is a perspective view of the hook member of the saw fence of FIG. 1.

A hook member 93 is pivotally attached to the base member 36 by a pin 94 at a location midway along channel 84. The pin is journaled into the hook member 93 and the ends are pressed into opposing bosses 96, 98. As best shown in FIG. 4, the hook member 93 includes an arcuate tongue portion 100 at one end and a plate 102 at an opposite end. The plate 102 includes an elongate slot 104 having a hemispherical beveled edge 106 extending about its outer periphery at an outwardly-facing surface 107.

As shown in FIG. 7, a threaded bolt 108 is threaded into an insert 110 which is pressed into a rear wall 112 of the housing 37. The inner end of the bolt 108 is cold-headed to form a hemispherical bearing surface 114 and a tip 116 which protrudes through the slot 104 of the hook member 93. The plate 102 of the hook member 93 is captured on the tip 116 on one side by the hemispherical bearing surface 114, and on the opposite side by a retaining ring 118. The opposite end of the bolt 108 protrudes outwardly from the rear wall 112 and is attached to a knob 120.

Figure 6:
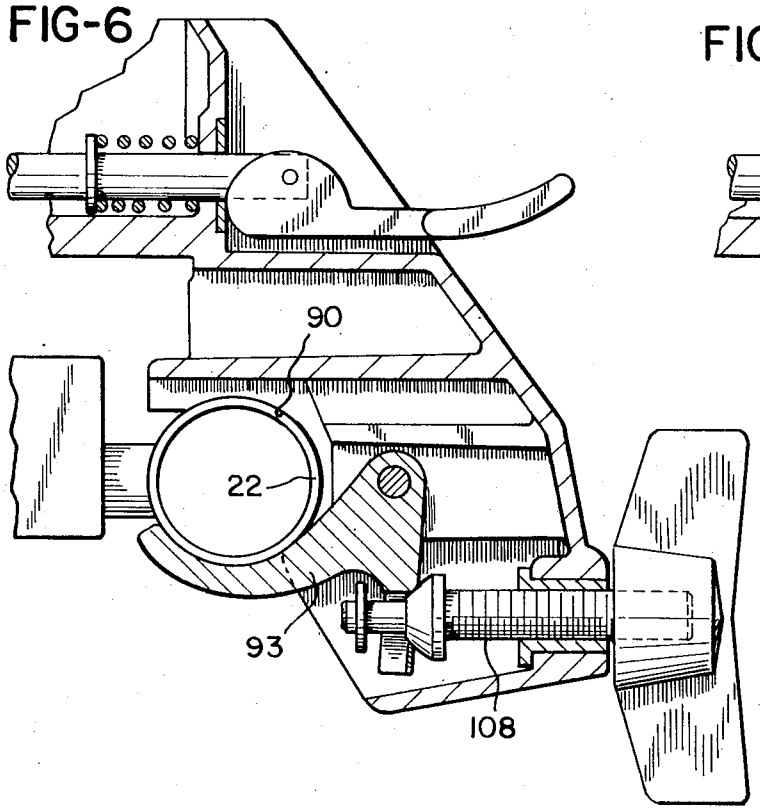
FIG. 6 is a detail of the saw fence of FIG. 1, showing a side elevation of the base member and hook member in section, adjusted to a locked position.

Rotation of the bolt 108, such that the bolt is displaced inwardly, causes the hook member 93 to be pivoted inwardly to engage the inside and lower portions of the side rail 22, as shown in FIG. 6. Rotation of the bolt 108 in an opposite sense causes the bolt to be displaced outwardly so that the hooked member is pivoted outwardly away from contact with the side rail, as shown in FIG. 7.

Figure 5:
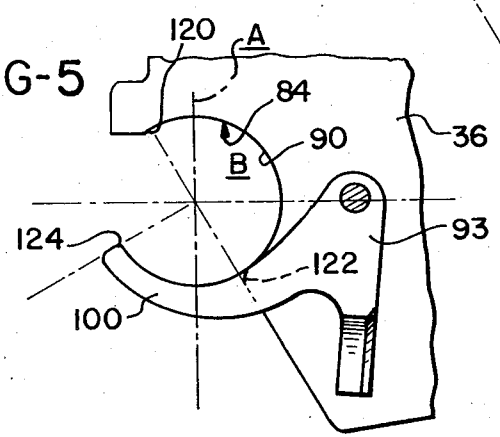
FIG. 5 is a somewhat schematic, side elevational view of the transverse channel and hook member of the saw fence of FIG. 1.

As shown in FIG. 5, the channel 84 is shaped such that it, and the contact surface 90, extend about approximately 180° of the circumference of the tubular side rail 22 (see FIG. 6). The contact surfaces 90 are oriented such that contact extends from a point 120, which is approximately 30° inwardly from a line A extending through the central axis B of the channel 84, and side rail 22 when in the channel, and oriented perpendicularly to the surface of the plate 14 (FIG. 1), to a point 122 which is located approximately 30° outwardly from line A.

When pivoted to the locked position, the tongue portion 100 of the hook member 92 extends around the underside of the side rail 22 and provides an area of contact which extends from a point 124 to the point 122, thereby providing an additional area of contact which extends approximately 80° from the point 122. Consequently, when in the locked position, the base member 36 extends about and contacts the outer periphery of the side rail 22 for approximately 260°. More importantly, the area of contact of the tongue portion 100 extends for approximately 50° past the line A.

Therefore, the pivoting of the tongue portion 100 into contact with the side rail 22 causes the housing 37 to be drawn inwardly and downwardly against the side rail 22 so that the side rail is urged into contact with the contact surfaces 90 along the channel 84, thereby performing a squaring function.

The operation of the saw fence 10 is as follows. In order to mount the saw fence on the side rails 20, 22 of a tabletop 12, the cam lever 66 is pivoted to the position 126 shown in phantom in FIG. 2, which allows the lock-back lever 46 to swing outwardly. The knob 120 is rotated to displace the hook member 92 outwardly relative to the base member 36. The saw fence is then lowered substantially vertically onto the side rails 20, 22 so that the boss 78 rests upon the upper surface of side rail 20, and side rail 22 is received within the channel 84 and rests on surfaces 90.

The knob 120 is then rotated in an opposite sense to pivot the hook member 100 inwardly so that it contacts the side rail 22 and draws the contact surfaces 90 of the channel 84 downwardly and inwardly against the outer surface of the side rail 22. Once this locking procedure has been affected, the saw fence is automatically locked onto the side rail 22 and squared relative to the tabletop 12.

The final step is the latching of the lock-back 74 by pivoting the cam lever 66 downwardly to draw the lock-back lever against the side rail 20. If it is desired to displace the saw fence 10 sidewardly, the cam lever 66 is pivoted upwardly and the knob 120 rotated to loosen the engagement of the hook member 92 sufficiently to allow the saw fence to be slid along the rails and re-positioned. The fence is again locked onto the rails by first locking the base member 36, then pivoting the cam lever 66 downwardly.

The saw fence 10 is removed from the table by pivoting the cam lever 66 upwardly, thereby disengaging the lock-back lever 46 from the rail 20, then rotating the knob 120 to pivot the hook member 92 outwardly. The fence may then be lifted substantially vertically from the table.

While the form of apparatus herein described constitutes a preferred embodiment of the invention, it is to be understood that the invention is not limited to this precise form of apparatus, and that changes may be made therein without departing from the scope of the invention.

What is claimed is:

1. For use with a saw table having first and second tubular side rails extending outwardly along a pair of opposing sides thereof, a removable saw fence comprising:

an elongate fence member;

lock-back means attached to an end of said fence member for engaging the first side rail of a saw table;

a base member attached to an opposite end of said fence member and including a housing having a contact surface forming a concave, transverse channel opening downwardly and inwardly toward an associated saw table, and shaped to engage the second side rail, said contact surface extending from an upper point inwardly of a vertical axis extending through a center of curvature of said surface to a lower point below a horizontal axis extending through said center of curvature;

a hook member pivotally attached to said housing and having a tongue portion extending downwardly and inwardly from said base member, said tongue portion being arcuately shaped to engage said second side rail, when pivoted into contact therewith, from an outer point thereof coincident with said lower point, to an inner point thereof above said lower point, such that pivotal movement of said hook member against said second side rail draws said channel downwardly and inwardly against said second side rail; and means for pivoting said hook member inwardly from said housing to a locked position against said second side rail, and outwardly away from said rail to a release position whereby sufficient clearance between said upper point and said inner point is created to allow said base member to be lifted upwardly and outwardly away from said second side rail.

2. The saw fence of claim 1 further comprising a plurality of said contact surfaces spaced along said housing and forming said channel.

3. The saw fence of claim 1 wherein said upper point extends 30° inwardly of said vertical axis, and said lower point extends 60° below said horizontal axis.

4. The saw fence of claim 1 wherein said lock-back means includes a lever pivotally attached to and extending downwardly from said fence member and shaped to engage said associated first side rail when pivoted inwardly, and means for pivoting said lever inwardly against said first side rail to a locked position, and outwardly away from said first side rail to provide sufficient clearance below said second rail to allow said fence member to be lifted upwardly away from said first side rail.

5. The saw fence of claim 1 wherein said hook member includes a plate; and said pivoting means includes bolt means threaded into said base member and rotatably connected to said plate, whereby displacement of said bolt means relative to said base member causes said hook member to pivot.

6. The saw fence of claim 5 wherein said plate includes a slot therethrough, and said bolt means is captured within said slot for slidable and rotatable movement relative thereto.

7. The saw fence of claim 6 wherein said bolt means includes a hemispherical bearing surface positioned to abut an outwardly-facing surface of said plate at said slot, and a retaining ring thereon positioned to abut said plate on an inwardly-facing surface thereof; and said slot includes a beveled edge at said outwardly-facing surface shaped to receive said bearing surface.

8. The saw fence of claim 1 wherein said contact surfaces are positioned at spaced intervals along said channel; and said hook member is substantially midway along said channel.

9. The saw fence of claim 1 wherein said contact surfaces each extend 180° about said axis.

10. The saw fence of claim 9 wherein said tongue portion is substantially arcuate in shape and extends 80° inwardly from said lower point.

* * * * *

UNITED STATES PATENT AND TRADEMARK OFFICE

CERTIFICATE OF CORRECTION

PATENT NO. : 4,658,687

DATED : April 21, 1987

INVENTOR(S) : Charles J. Haas, et al.

It is certified that error appears in the above-identified patent and that said Letters Patent is hereby corrected as shown below:

Column 3, line 55, {deisgnated" should be --designated--,

Column 6, line 45, (Claim 1), "said rail" should be --said second side rail--.

Signed and Sealed this

Twenty-fifth Day of August, 1987

*Attest:*

DONALD J. QUIGG

*Attesting Officer*

*Commissioner of Patents and Trademarks*